US005397052A

United States Patent [19]

Walz

[11] Patent Number: 5,397,052

[45] Date of Patent: Mar. 14, 1995

[54] CONTINUOUS MAILING FORMS

[75] Inventor: Gerard F. Walz, Fallbrook, Calif.

[73] Assignee: Walz Postal Solutions, Inc., Fallbrook, Calif.

[21] Appl. No.: 82,962

[22] Filed: Jun. 28, 1993

Related U.S. Application Data

[60] Continuation of Ser. No. 22,185, Feb. 25, 1993, Pat. No. 5,325,303, which is a division of Ser. No. 406,732, Sep. 13, 1989, Pat. No. 5,190,210.

[51] Int. Cl.[6] ..... B65D 27/06

[52] U.S. Cl. ..... 229/300; 229/69; 229/74; 229/92.8; 283/81

[58] Field of Search ..... 229/69, 74, 92.8, 300; 283/81

[56] References Cited

U.S. PATENT DOCUMENTS

| | | | |
|---|---|---|---|
| 3,987,960 | 10/1976 | Gardiner | 229/74 |
| 4,029,341 | 6/1977 | Neill et al. | 283/81 X |
| 4,211,434 | 7/1980 | Reese | 229/69 |
| 4,277,089 | 7/1981 | Lockhart | 283/81 X |
| 4,407,524 | 10/1983 | Trautlein | 229/74 X |
| 4,598,935 | 7/1986 | Stewart | 229/74 X |
| 4,614,361 | 9/1986 | Foster | 283/81 X |
| 4,682,793 | 7/1987 | Walz | 229/69 X |
| 4,900,597 | 2/1990 | Kurtin | 229/300 X |
| 4,995,642 | 2/1991 | Juszak et al. | 283/81 X |
| 5,267,898 | 12/1993 | Doll et al. | 229/300 X |

*Primary Examiner*—Allan N. Shoap
*Assistant Examiner*—Jes F. Pascua
*Attorney, Agent, or Firm*—Brown, Martin, Haller & McClain

[57] ABSTRACT

A continuous mailing form includes one or more sheets of individual form parts secured together along spaced transverse tear lines. The or each sheet has a designated addressee area on each form part, and, where there is more than one sheet, the sheets are secured together with the addressee areas in registry. One of the sheets has a predetermined detachable area comprising a return postcard. A blow-on label is detachably secured to the addressee area on each form part of one of the sheets, for receiving address information and reproducing it on the underlying addressee area of the underlying sheet or sheets. The label can be peeled off and attached to an item to be mailed along with the return postcard.

9 Claims, 4 Drawing Sheets

CONTINUOUS MAILING FORMS

This is a continuation of application Ser. No. 08/022,185, filed Feb. 25, 1993, now U.S. Pat. No. 5,325,303, which was a Divisional of application Ser. No. 07/406,732, filed Sep. 13, 1989, now U.S. Pat. No. 5,190,210.

BACKGROUND OF THE INVENTION

The present invention relates generally to mailing forms and procedures as used for keeping track of mailed items for insurance purposes, for confirmation of delivery to a customer, and/or for record keeping purposes. Some mailing procedures with which this invention is particularly concerned are known as certified and registered mail.

In any business a large number of items and/or correspondence is mailed to customers on a daily basis. Some, if not all, of these mailings must be tracked for various reasons, for example for insurance purposes in the case of items of value. The paperwork needed to keep track of business mailings via certified or registered mail, or even simply to record standard mailings, is lengthy and tedious to complete, particularly in the case of large businesses with bulk mailings on a daily basis.

In my U.S. Pat. No. 4,682,793, a continuous mailer form is described which is particularly designed to meet Post Office certified mail requirements. The multiple layers of the form include all the paperwork required for simultaneous completion of a mailing label, customer receipt, and return receipt for each item mailed. Thus, all the paperwork required for each item to be mailed on a particular occasion can be filled out in one pass simply by running the continuous form through a computer printer or typewriter and entering the respective customer addresses on each form, detaching the forms on completion and attaching the mailing address, item identification number (e.g. the certified mail number), and return receipt to the respective items to be mailed.

However, even this procedure still requires a relatively large amount of manual paperwork to compute postage, to keep records of mailings and receipt numbers, and to track when receipts are returned. The current process for preparing registered or certified articles for mailing, and for other types of mail tracking procedures, requires the typing, handwriting or computer generation of an address label which typically includes at least the addressee's name and address, as well as an identifying file number. This label is then attached to the article to be mailed, either by affixing it to the exterior of the article or as an insert into a window envelope. In the case of registered or certified mail, the Postal Service approved label carrying the certified or registered mail number must also be affixed to the package. The same identifying number must be entered by the user On the return postcard, either by hand or using a typewriter. The type of service (certified, registered, insured,etc.) must also be checked off on the return postcard, and the addressee section completed. Finally, the return address must be entered on the reverse side of the postcard before affixing it to the item to be mailed. The sender must also prepare the paperwork required both for internal record keeping and to satisfy Postal Service requirements. This includes the addressee, type of mailing, actual value, postage, and identifying number for each item mailed. This is typically done by hand, which is a lengthy and tedious procedure and often gives rise to errors, potentially resulting in loss of coverage if the item should be lost.

SUMMARY OF THE INVENTION

It is an object of this invention to provide an improved mailing form.

According to the present invention, a continuous mailing form is provided which comprises at last one continuous sheet of individual form parts secured together along spaced transverse tear lines, the sheet having lines of pin feed perforations extending along its opposite outer marginal side edges, each individual form part having spaced longitudinal tear lines for separating a predetermined detachable area of form part from the remainder of the form for attachment to an item to be mailed, the predetermined detachable area comprising a return postcard and having printed indicia on both of its faces including marked areas for receiving predetermined information concerning a mailed item, one of said areas on a first face of the return postcard comprising a designated addressee area for receiving the address to which the item is to be mailed. In one embodiment of the invention the form includes a front sheet and a rear sheet, each sheet comprising a continuous sheet of individual form parts secured together along spaced transverse tear lines, and at least one of the sheets having lines of pin feed perforations extending along its opposite outer marginal side edges. Each form part of each sheet has a designated addressee area for receiving the address to which the item is to be mailed. Preferably, a blown-on label detachably secured to the designated addressee area on each form part of one of the sheets for receiving address information and for reproducing any information imprinted on it onto an underlying addressee area on the underlying addressee area on the form part and the form part of any underlying sheet. The blown-on label is preferably of the known peel off, "self-imaging" type-comprising a two layer label including a bottom layer adhesively securable to an underlying sheet, and a top, peel off layer detachably secured to the underlayer and comprising a carbonless type of copy paper which will transfer any information imprinted on it onto the bottom layer, which remains on the form part when the top layer is detached to identify the article addressee. Once the addressee information has been imprinted on the blown-on label of a series of forms, the respective individual forms or form parts can be detached and the upper layer of the label detached for securing to the item to be mailed. At the same time, the return postcard itself is attached elsewhere to the item to be mailed via suitable lines of adhesive provided on the reverse side of the card where the return address of the sender is imprinted. The return card itself may be separable from the adhesive lines via suitable additional tear lines.

Preferably, each individual form of one of the sheets also carries an item identifying number, such as a registered for certified mail number, for example, which may be imprinted at a suitable location on the return postcard and also provided elsewhere on the form in the form of a detachable label for attachment to the article to be mailed.

It can be seen that this form considerably reduces the paperwork and time required for preparing items for mailing, keeping records of mailings, and tracking receipt of mailed items. All of the labels required for specific types of mailings, such as certified or registered mail, are provided on a single form in a continuous format, which also includes the required return postcard for additional confirmation of receipt which may be previously imprinted with the respective article number. The sender simply has to enter a sequence of addressee information for a plurality of items to be mailed, along with the information required to compute the postal fee, and can then print a series of forms. The sender then takes the forms, separates them into individual forms, and separates the address label and article identifying number label from each form and affixes them both to the respective article to be mailed. The return postcard is then also taken and affixed to the article. No entering of names and addresses and/or article numbers on the article or return postcard is required. This considerably reduces mail processing time, reducing manpower requirements and expense.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENTS

Figure 1:
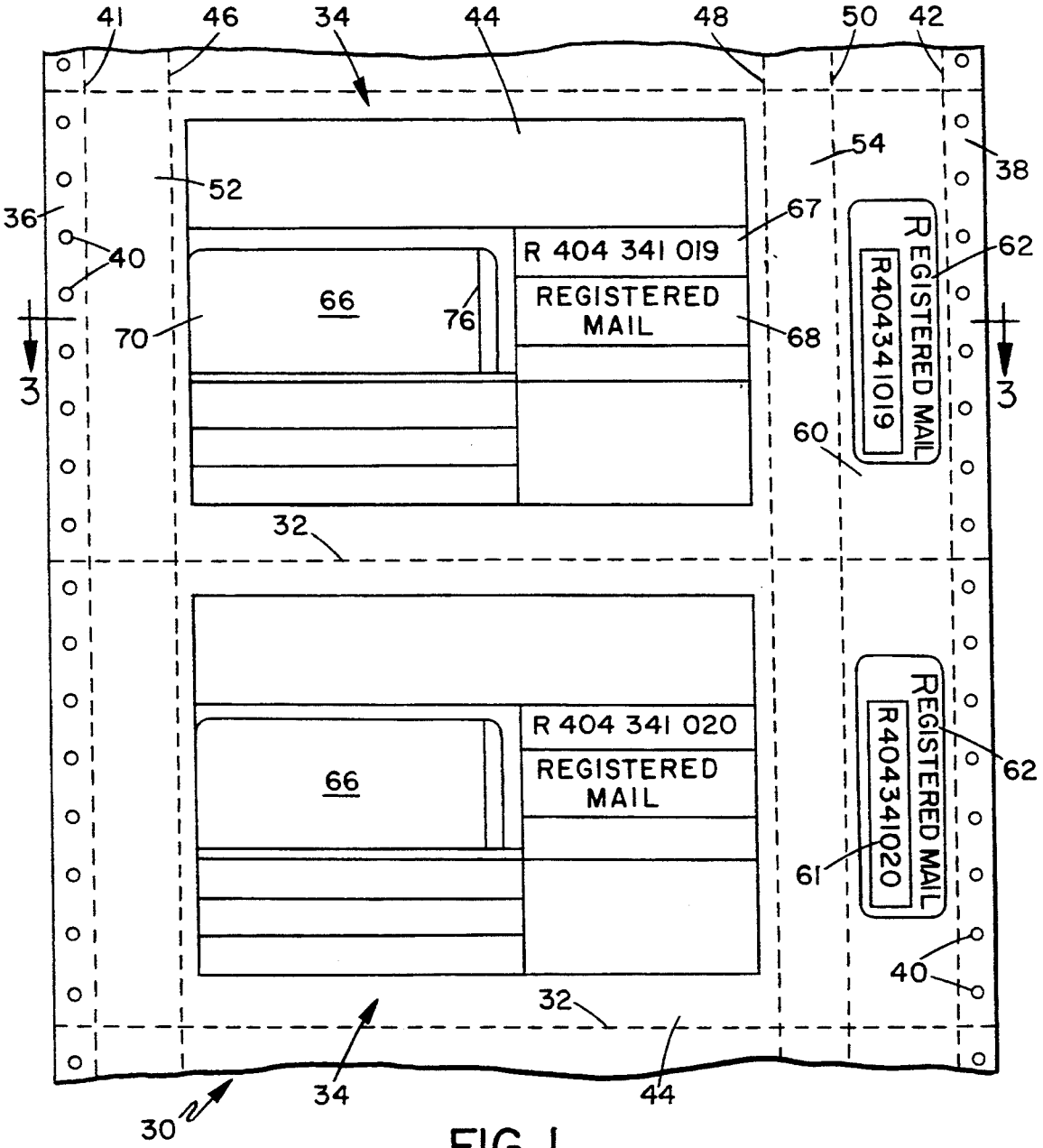
FIG. 1 is front elevational view of a length of a first type of continuous mailing form according to a first embodiment of the present invention.
Figure 2:
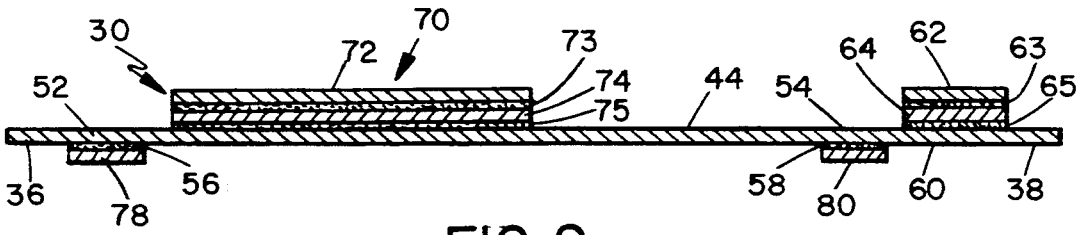
FIG. 2 is an exploded cross-section through the form on the lines 2—2 of FIG. 1.
Figure 3:
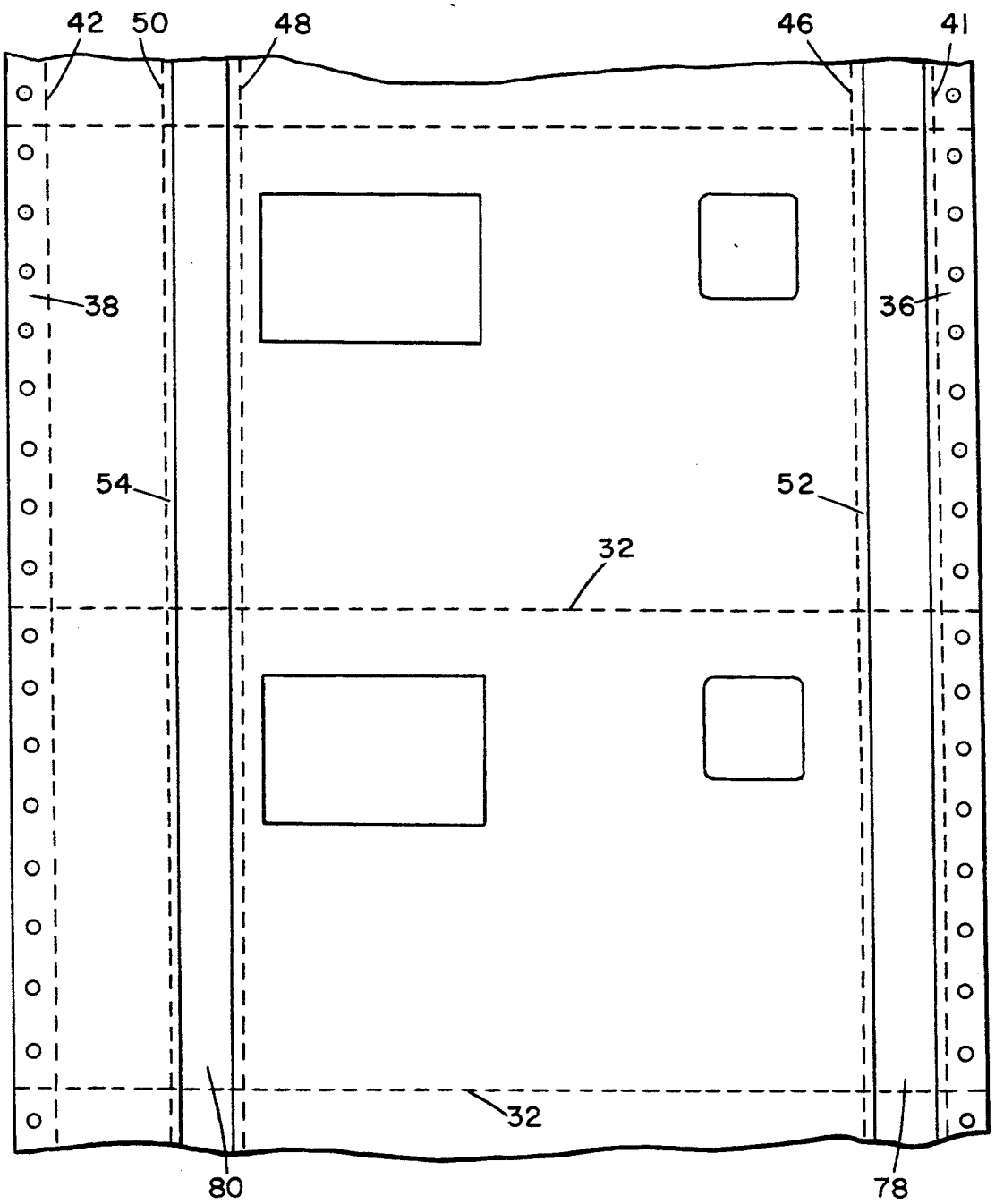
FIG. 3 is a rear elevational view of the form of FIG. 1.

The one layer continuous form 30 illustrated in FIGS. 1–3 is particularly designed for registered mailing procedures. However, the form may be alternatively designed for certified mailing or other types of mail tracking, for example as a simple return receipt for merchandise. The single layer of the form 30 is of a card material such as that used by the Post Office for return receipts (e.g. PS Form 3811). The form 30 has a series of equally spaced, transverse tear lines 32 for separating the form into individual form lengths or parts 34. Each form length corresponds to the length of a standard Post Office return postcard or receipt. The opposite outer marginal side edges 36,38 of the form are provided with lines of pin feed perforations or socket holes 40 arranged to allow the form to be fed continuously through the standard tractor feed of various data processing machines such as printers with the perforations engaged on the feed pins or drive spindles of the printers. The width of the form is therefore equivalent to the width of standard paper used in such printers. Longitudinal tear lines 41,42 are provided adjacent the marginal side edges to allow the individual form lengths to be separated from the marginal edge portions carrying the pin feed perforations.

Each form length or part has a central portion 44 comprising a return receipt or postcard which is preferably of a type similar or equivalent to that used by the Postal Service for the type of mailing for which the form is intended. In the embodiment illustrated, the return receipt is designed for registered mail and is of the same dimensions as U.S. Post Office PS Form 3811. However, it may alternatively be designed for certified or other types of mailing. Additional spaced longitudinal tear lines 46,48,50 are provided for separating the central area or return receipt portion 44 from the remainder of the individual form part, and for separating side edge strips 52,54 of the portion 44 which carry self adhesive strips 56,58 (see FIGS. 2 and 3) from the remainder of portion 44. An additional portion or strip 60 of the form which remains after the return receipt portion is detached along tear line 50 carries a continuous series of labels 62, one per form length, carrying identifying indicia 61 for identifying specific mailed items according to Post Office requirements, for example. In the embodiment illustrated, the labels 60 are designed for registered mail and carry a continuous numbered sequence of successive registered mail numbers, which are printed according to Post Office format requirements, which currently require OCR-A type letter format for registered mail number labels. The labels 60 in the illustrated embodiment are of the red U.S. Postal Service "Label 200" type, and have adhesive backings 63 releasably securing them to a backing layer or strip 64 which is secured to the underlying portion of the form by any suitable adhesive 65, such as double sided adhesive tape strips. The labels 60 can be peeled off the backing layer for securing to a series of items to be mailed when desired.

The front face of the return receipt portion 44 of each form part is imprinted with predetermined indicia including a number of blocks for entry of appropriate information as is normally required in a standard mailing procedure such as registered mailing. One of the blocks 66 defines an area for entry of the addressee information, while another block 67 is pre-printed with the same identifying indicia or number as label 60 alongside that particular receipt portion. Block 68 is preprinted to identify the type of mailing (for example registered mail as illustrated, or alternatively certified mail or other types of mailing procedures). Other blocks are provided for completion on receipt by the addressee prior to mailing the card back to the sender.

Each block 66 defining the area for receiving addressee information is provided with a self-imaging, blown-on label 70 of appropriate dimensions on which the addressee information can be imprinted to provide both an article address label and the required addressee information on the return postcard. As best illustrated in FIG. 2, blown-on label 70 is in two parts, including a peel off upper part 72 which is adhesively secured via suitable adhesive 73 to an underlying, self imaging lower part 74. The lower part is secured to the appropriate area 61 of the return receipt portion of a respective form length by a suitable adhesive 75, such as double sided adhesive tape. The lower part is of a known self imaging material which will reproduce any information imprinted on the upper part, such as carbonless copy paper of which NCR paper is typical. A score line 76 is provided adjacent one side edge of the upper part of label 70 to aid in peeling off the upper part from the lower part.

The rear face of the return receipt portion 44 can be seen in FIG. 3. It includes self-adhesive strips 56,58 extending along its opposite marginal side edges outside tear lines 46,48, and covered by strips 78,80 of a suitable cover material for protective purposes. The area inside tear lines 46,48 carries return address information, which may be pre-printed, and a marked stamp area as well as other instructional information if desired.

The continuous mail form is utilized by first feeding it into a suitable printer unit or typewriter. It may be utilized in a system for automatically printing a series of previously entered or programmed names and addresses sequentially on the labels 70 of successive form lengths of the continuous form, or alternatively the operator may successively enter the required addressee information using a typewriter or data processor. Once the required number of form lengths has been completed with the desired addressee information, the completed form parts are separated into individual form lengths via tear lines 32. In order to prepare each item or package for mailing, the upper part of label 70 is peeled off and attached to the item as the address label, and the identifying number label 62 on strip 60 is similarly peeled off and attached at an appropriate location on the package. The return receipt portion is detached along tear lines 41 and 50 from the left hand side pin feed portion 36 and from the side portion 60 which carried the number label 62. The detached portions 36 and 60 can be discarded, while portion 44 is secured to the package by adhesive strips 56,58. The return receipt portion will already carry the addressee information on the lower part of label 70, so no manual entries are required on portion 44. Once the correct postage has been applied, the item is ready for mailing.

When the addressee receives the item, the postal officer or deliverer simply detaches the return receipt from the packaging via tear lines 46 and 48, signs their name in the appropriate block, and has the addressee sign at the appropriate location before returning the card to the sender.

Figure 4:
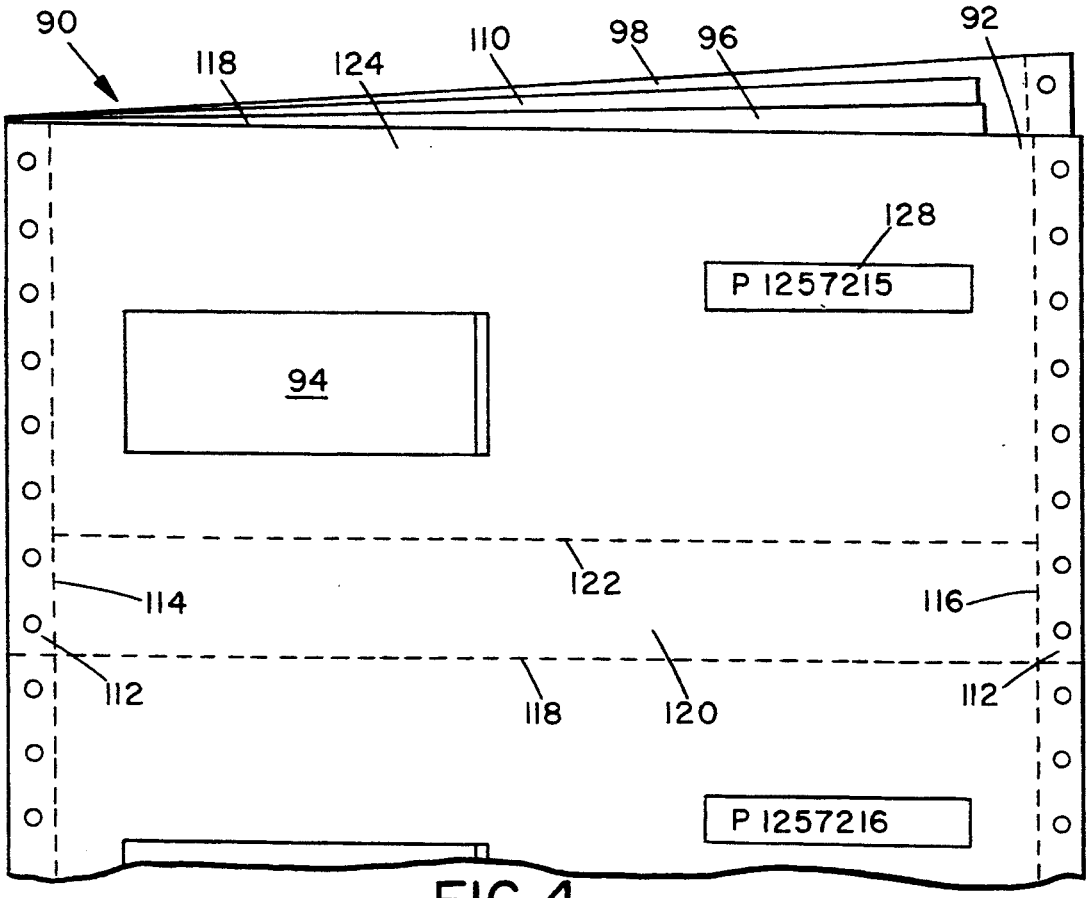
FIG. 4 is a perspective view of a length of a second type of continuous mailing form according to the invention.
Figure 5:
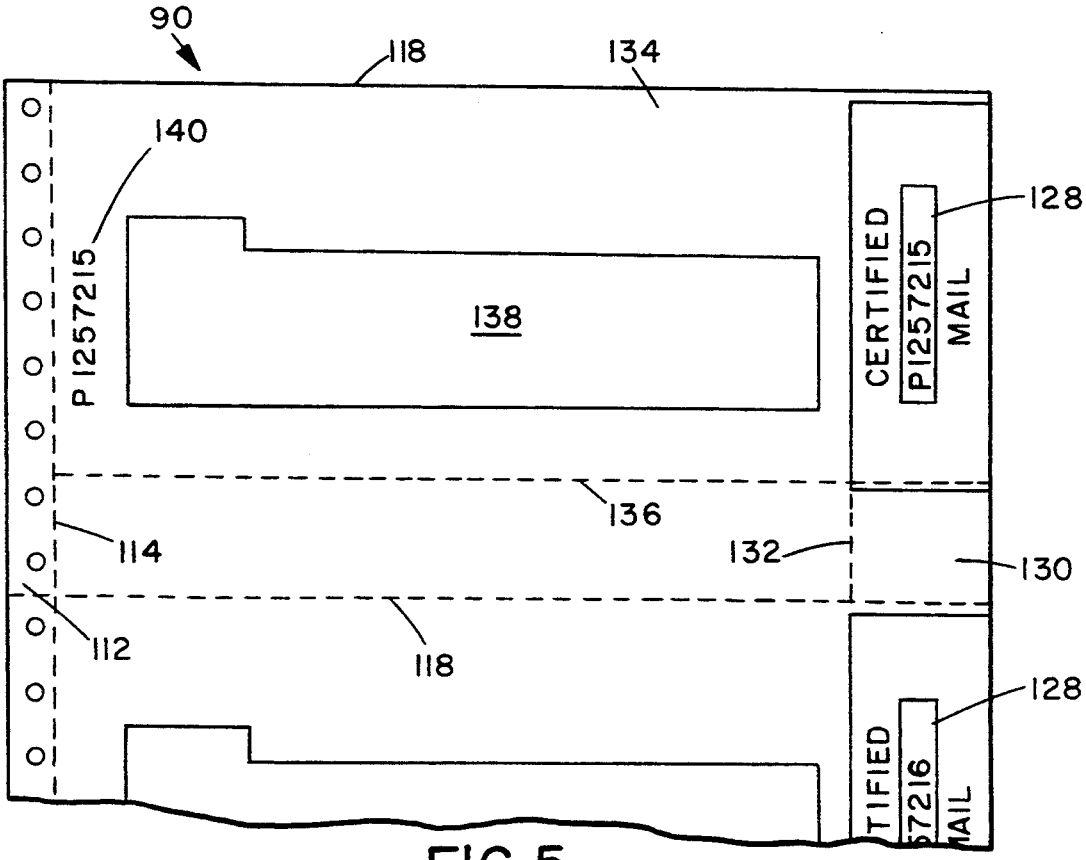
FIG. 5 is a front elevational view of an inner sheet of the form of FIG. 4.
Figure 6:
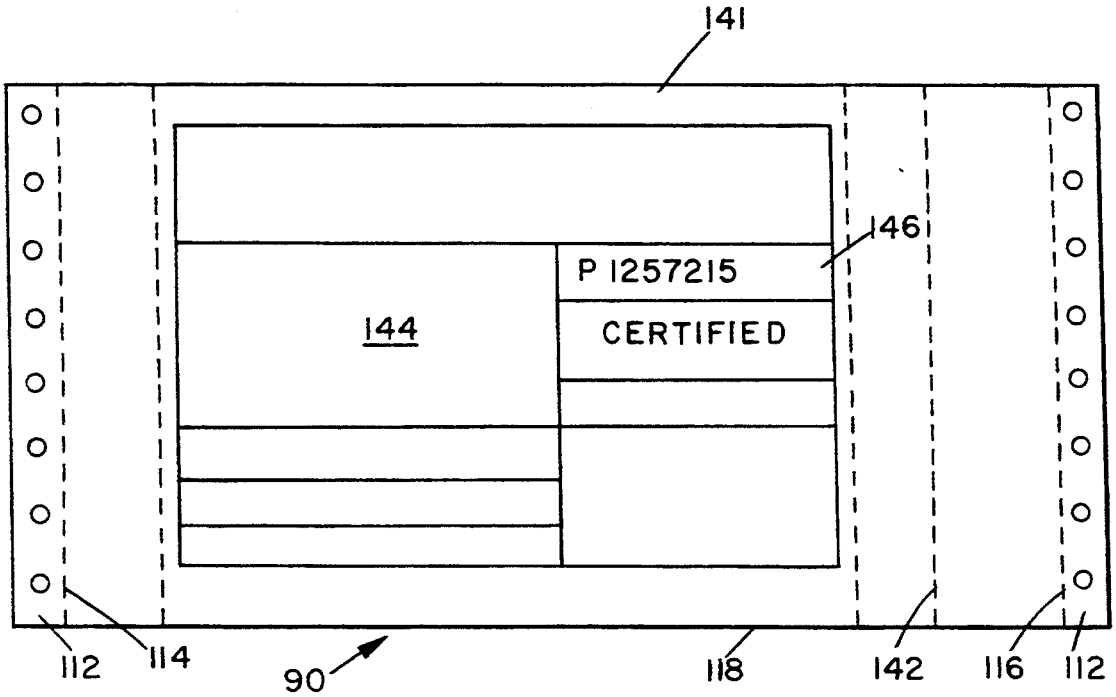
FIG. 6 is a front elevational view of the rear sheet of the form of FIG. 4.

Another continuous mailing form 90 is illustrated in FIGS. 4–6. This form is a multi-sheet form instead of a single sheet form as in FIGS. 1–3, and includes a front sheet 92 carrying a mailing label 94 of the same blown-on, self-imaging type as label 70 in the previous embodiment, an intermediate sheet 96 comprising a sender's receipt or proof of mailing type form, and a rear sheet 98 which incorporates a return receipt or postcard of a similar type to that utilized in the form of FIGS. 1–3. A sheet 110 of carbon paper may be provided between the intermediate and rear layers, or alternatively these layers may be of the carbonless copy type so that information imprinted on the front sheet is transferred to the underlying layers. The form illustrated in FIGS. 4–6 is particularly designed for certified mailing procedures, although it may alternatively be designed of other types of mailing.

The successive sheets of the form are secured together by adhesive along one marginal side edge, and the front and rear sheets, which are of equivalent width, are provided with lines of pin feed perforations 112 along their opposite marginal side edges which can be separated from the remainder of these sheets via longitudinal tear lines 114,116. Spaced transverse tear lines 118 which extend through all the sheets of the form allow the form to be separated into individual form lengths or parts 120. Each form length of the front sheet carries an additional transverse line of perforations 122 for separating out a portion 124 of the form carrying address label 94. Portion 124 is dimensioned for fitting in a standard window envelope if desired, or alternatively may be used for record keeping purposes with the peel-off upper part of label 94 peeled off and attached to the item to be mailed. As in the previous embodiment, label 94 is of the two-part, self-imaging type so that when the upper part is detached, the underlying part, which will be imprinted with any information applied to the upper part, will remain attached to portion 124. Portion 124 is also pre-printed with an identifying code or number 128, for example a certified mail number or other code for identifying a specific item of mail.

The intermediate layer of a form length of the multi-part continuous form is illustrated in FIG. 5, and comprises a side strip portion 130 detachable from the remainder of the form length via longitudinal tear line 132 and imprinted with the same identifying code 128 as the remainder of the form. The strip has adhesive on its rear face covered with a peel off cover sheet (not illustrated) so that it can be detached and secured to a package. The intermediate layer also includes a sender's receipt portion 134 for receiving a postmark as the sender's proof of mailing, which may be equivalent to Post Office Form 3800, for example, as illustrated in the drawing. Receipt portion 134 is detached from the remainder of the form layer via additional transverse tear line 136 as well as longitudinal tear lines 114 and 132. It includes an addressee information area 138 which is in registry with the address label area of the front sheet when the two sheets are secured together along their left hand side margin. The sender's receipt is also imprinted with the same identifying number as the side strip and the front sheet, in area 140.

The rear sheet of the form is illustrated in FIG. 6 and is similar to the single sheet form length of FIG. 1 to 3 in that it includes a return receipt portion 141 similar to a standard Post Office return receipt card (PS Form 3811) detachable from the remainder of the form length of each rear sheet via tear lines 114 and 142. The return receipt portion includes pre-printed blocks for receiving similar information to the return receipt portion of the form of FIGS. 1–3, including an addressee area 144 which is blank, and an article number area 146 which is preprinted with the same article identifying number as the front and intermediate sheets. The addressee area is positioned for registry with the address area on the front sheet and intermediate sheets. The rear face of return receipt portion 141 will be identical to that of the return receipt portion of the alternative form illustrated in FIG. 3.

Both the single sheet continuous form of FIGS. 1–3 or the multi-sheet form of FIGS. 4–6 may be provided in alternative versions designed for various alternative types of mailing, for example registered, certified, merchandise delivery receipt, etc. The single layer form of FIGS. 1–3 has the advantage of reduced thickness and reduced paperwork. In each case, the continuous forms may be incorporated in a mailing procedure utilizing an existing manual record keeping system. They may also be used in an automated mail preparation, record keeping and tracking system in which one or more continuous mailing forms is automatically prepared and corresponding records stored for subsequent printing of reports as required by the Post Office and also as desired by the user of the system for tracking purposes.

The continuous mailing form described above is easy and convenient to use with a minimum of paperwork. When used in conjunction with the automated mail preparation, record keeping, and tracking system, the manual work necessary in any mail room will be dramatically decreased, reducing expense.

Although a preferred embodiment of the invention has been described above by way of example only, it will be understood by those skilled in the field that modifications may be made to the disclosed embodiment without departing from the scope of the invention, which is defined by the appended claims.

We claim:

1. A mailing form assembly, comprising:

a front sheet and a rear sheet, each sheet having opposite outer marginal side edges and the sheets being adhesively secured together along at least one side edge;

each sheet comprising a plurality of individual form parts secured together along spaced transverse tear lines;

at least one of the sheets having lines of pin feed perforations extending along said opposite outer marginal side edges;

one of the sheets having spaced longitudinal tear lines for separating a predetermined detachable area of the form part from the remainder of the form part for attachment to an item to be mailed, the predetermined detachable area comprising a return postcard having printed indicia on both of its faces including marked areas for receiving predetermined information concerning a mailed item;

each individual form part of each of the sheets having a designated addressee area in registry with the addressee area of the form part of the other sheet for receiving the address of where the item is to be mailed; and each form part of one of the sheets further including an identifying code label having means for securing it to an item to be mailed, the label being detachably secured to the remainder of the sheet.

2. A mailing form assembly, comprising:

a front sheet and a rear sheet, each sheet having opposite outer marginal side edges and the sheets being adhesively secured together along at least one side edge;

each sheet comprising a plurality of individual form parts secured together along spaced transverse tear lines;

one of the sheets having spaced longitudinal tear lines for separating a predetermined detachable area of the form part from the remainder of the form part for attachment to an item to be mailed, the predetermined detachable area comprising a return postcard having printed indicia on both of its faces including marked areas for receiving predetermined information concerning a mailed item;

each individual form part of each of the sheets having a designated addressee area in registry with the addressee area of the form part of the other sheet for receiving the address of where the item is to be mailed;

a blown-on label assembly secured to the designated addressee area on each form part of one of the sheets, the assembly comprising a detachable address label for attachment to an item to be mailed and means for duplicating the address printed on the address label on the underlying addressee area; and the blown on label assembly comprising a detachable peel-off upper part comprising the address label and a lower part adhesively secured to the addressee area of the respective form part, the lower part comprising means for transferring any information imprinted onto the upper part on the lower part.

3. A mailing form assembly, comprising:

a front sheet and a rear sheet, each sheet having opposite outer marginal side edges and the sheets being adhesively secured together along at least one side edge;

each sheet comprising a plurality of individual form parts secured together along spaced transverse tear lines;

one of the sheets having spaced longitudinal tear lines for separating a predetermined detachable area of the form part from the remainder of the form part for attachment to an item to be mailed, the predetermined detachable area comprising a return postcard having printed indicia on both of its faces including marked areas for receiving predetermined information concerning a mailed item;

each individual form part of each of the sheets having a designated addressee area in registry with the addressee area of the form part of the other sheet for receiving the address of where the item is to be mailed;

a blown-on label assembly secured to the designated addressee area on each form part of one of the sheets, the assembly comprising a detachable address label for attachment to an item to be mailed and means for duplicating the address printed on the address label on the underlying addressee area; and each form part of one of the sheets including an area outside said addressee area and an identifying number label detachably secured to said area, the identifying number label having a peel-off adhesive coating on one face comprising means for detachably securing it to said area and subsequently attaching it to an item to be mailed.

4. A mailing form assembly, comprising:

a front sheet and a rear sheet, each sheet having opposite outer marginal side edges and the sheets being adhesively secured together along at least one side edge;

each sheet comprising a plurality of individual form parts secured together along spaced transverse tear lines;

one of the sheets having spaced longitudinal tear lines for separating a predetermined detachable area of the form part from the remainder of the form part for attachment to an item to be mailed, the predetermined detachable area comprising a return postcard having printed indicia on both of its faces including marked areas for receiving predetermined information concerning a mailed item;

each individual form part of each of the sheets having a designated addressee area in registry with the addressee area of the form part of the other sheet for receiving the address of where the item is to be mailed;

a blown-on label assembly secured to the designated addressee area on each form part of one of the sheets, the assembly comprising a detachable address label for attachment to an item to be mailed and means for duplicating the address printed on the address label on the underlying addressee area; and each form part of one of the sheets further includes an identifying label having identifying indicia for identifying a mailed item, the label having means for securing it to an item to be mailed, and being detachably secured to the remainder of the form part.

5. The assembly as claimed in claim 4, wherein the form part including an identifying number label further includes an additional detachable area for releasably carrying said identifying label and secured to one side of said first detachable area along a longitudinal tear line.

6. The assembly as claimed in claim 4, wherein at least some of the identifying indicia on each identifying label are numbers, and the identifying labels are numbered consecutively on successive form parts and the indicia on each identifying label are also imprinted on said return postcard.

7. The assembly as claimed in claim 4, wherein said return postcard has the format and dimensions of a Post Office return postcard for registered or certified mailing.

8. The assembly as claimed in claim 4, wherein the rear sheet includes said return postcard, and the front sheet carries said blown on label assembly.

9. The assembly as claimed in claim 4, including copy producing means for duplicating the address printed on the front sheet on the underlying addressee area of the rear sheet.

* * * * *